US012318887B2

(12) United States Patent
Tucker et al.

(10) Patent No.: US 12,318,887 B2
(45) Date of Patent: Jun. 3, 2025

(54) WORKPIECE HOLDING ASSEMBLY FOR A GRINDING MACHINE AND GRINDING METHODS

(71) Applicant: Fives Landis Limited, Keighley (GB)

(72) Inventors: Matthew Tucker, Bedford (GB); Paul Comley, Stotfold (GB); Mark Stocker, Northampton (GB)

(73) Assignee: Fives Landis Limited, Keighley (GB)

( * ) Notice: Subject to any disclaimer, the term of this patent is extended or adjusted under 35 U.S.C. 154(b) by 565 days.

(21) Appl. No.: 17/775,535

(22) PCT Filed: Nov. 12, 2020

(86) PCT No.: PCT/GB2020/052877
§ 371 (c)(1),
(2) Date: May 9, 2022

(87) PCT Pub. No.: WO2021/094756
PCT Pub. Date: May 20, 2021

(65) Prior Publication Data

US 2022/0388107 A1 Dec. 8, 2022

(30) Foreign Application Priority Data

Nov. 15, 2019 (GB) ..... 1916639
Oct. 13, 2020 (GB) ..... 2016217

(51) Int. Cl.
*B24B 5/12* (2006.01)
*B24B 41/06* (2012.01)

(52) U.S. Cl.
CPC ..... *B24B 5/12* (2013.01); *B24B 41/061* (2013.01)

(58) Field of Classification Search
CPC .... B24B 5/02; B24B 5/04; B24B 5/06; B24B 5/10; B24B 5/16; B24B 5/18; B24B 5/22;
(Continued)

(56) References Cited

U.S. PATENT DOCUMENTS 2,478,607 A * 8/1949 Theler ..... B24B 5/35 451/244
2,790,274 A * 4/1957 Crompton, Jr. ..... B24B 5/35 451/244

(Continued)

FOREIGN PATENT DOCUMENTS

CN 2584349 Y 5/2003
CN 206748212 U 12/2017

(Continued)

OTHER PUBLICATIONS

Machine-generated English language translation of China Utility Model No. CN 2584349 Y, downloaded from patents.google.com on Apr. 29, 2022.

(Continued)

*Primary Examiner* — Joel D Crandall
(74) *Attorney, Agent, or Firm* — Kolitch Romano Dascenzo Gates LLC

(57) ABSTRACT

A workpiece holding assembly comprises a magnetic chuck, and first and second separate sets of workrests for engaging with the outer circumferential surface of an annular workpiece. The workrests are configurable such that when the outer circumferential surface of the workpiece is ground with the chuck rotating in one direction, the outer circumferential surface is only urged in contact with the first set of workrests, and when an inner circumferential surface of said workpiece is ground with the direction of rotation of the chuck reversed, the outer circumferential surface is only urged in contact with the second set of workrests. Grinding methods using such a workpiece holding assembly are also described.

18 Claims, 15 Drawing Sheets

(58) Field of Classification Search
CPC .. B24B 5/28; B24B 5/307; B24B 5/35; B24B 5/42; B24B 5/421
See application file for complete search history.

(56) References Cited

U.S. PATENT DOCUMENTS

| | | | | | |
|---|---|---|---|---|---|
| 2,838,885 | A | * | 6/1958 | Cann | B24B 5/307 451/244 |
| 2,838,888 | A | * | 6/1958 | Cann | B24B 5/307 451/244 |
| 2,927,406 | A | * | 3/1960 | Terp | B24B 41/005 451/244 |
| 3,854,252 | A | * | 12/1974 | Lindsay | B24B 5/35 451/244 |
| 5,108,117 | A | * | 4/1992 | Crossman | B24B 47/22 82/170 |
| 5,213,348 | A | * | 5/1993 | Crossman | B24B 47/22 82/170 |
| 6,148,248 | A | * | 11/2000 | Sun | B24B 5/307 451/5 |
| 2020/0282511 | A1 | * | 9/2020 | Ebina | B24B 41/06 |

FOREIGN PATENT DOCUMENTS

| | | | | |
|---|---|---|---|---|
| EP | 2319656 | A2 | | 5/2011 |
| JP | H04-125556 | U | | 11/1992 |
| JP | H10-202487 | A | | 8/1998 |
| JP | 2004-142008 | A | | 5/2004 |
| JP | 2011-073082 | A | | 4/2011 |
| JP | 2017064841 | A | * | 4/2017 |
| JP | 2017-164850 | A | | 9/2017 |

OTHER PUBLICATIONS

Machine-generated English language translation of Japan Patent Publication No. JP 2017064841 A, downloaded from patents.google.com on Apr. 29, 2022.

Machine-generated English language translation of China Utility Model Publication No. CN 206748212 U, downloaded from patents.google.com on Apr. 29, 2022.

Schulz, Barbara, "ID and OD Shoe Grinding for Thin-Walled Workpieces," Production Machining magazine, Aug. 23, 2017, available from https://web.archive.org/web/20180612184438/https://www.productionmachining.com/articles/id-and-od-shoe-grinding-for-thin-walled-workpieces.

Search Report issued in connection with United Kingdom Patent Application No. GB 1916639.6, United Kingdom Intellectual Property Office, May 7, 2020.

Search Report issued in connection with United Kingdom Patent Application No. GB 2016217.8, United Kingdom Intellectual Property Office, Apr. 13, 2021.

* cited by examiner

WORKPIECE HOLDING ASSEMBLY FOR A GRINDING MACHINE AND GRINDING METHODS

FIELD OF THE INVENTION

The present invention relates to a workpiece holding assembly for a grinding machine, and more particularly to such an assembly which is suitable for holding an annular workpiece during grinding. Methods of grinding using such an assembly to hold the workpiece are also described.

BACKGROUND OF THE INVENTION

A thin annular workpiece may not be intrinsically stiff across its diameter. The workpiece needs to be secured to a work spindle during grinding without causing undue radial deformation. Workpieces of this form may be gripped using scroll chucks, expanding mandrels and collet chucks. The amount of force used to hold the part can be reduced to minimise distortion, but this may be at the expense of machining cycle time as the cutting forces need to be limited to avoid causing the workpiece to break free.

Magnetic faceplates or chucks are also used in both surface grinding and rotary grinding processes. They are particularly suitable where one face of a workpiece can be pre-machined to a flatness where any mechanical distortion caused by a magnetic chuck will be significantly less than the level of precision required of the finished part.

Shoe or microcentric grinding provides a workholding method that allows workpieces to be robotically loaded and machined on both outer and inner circumferential surfaces.

SUMMARY OF THE INVENTION

The present invention provides a workpiece holding assembly for a grinding machine, the assembly comprising:

- a magnetic chuck for holding a workpiece which has an outer circumferential surface and an inner circumferential surface located concentrically about a workpiece central axis;
- a chuck drive for rotating the chuck about a chuck rotational axis during grinding; and
- first and second separate sets of workrests for engaging with the outer circumferential surface of an annular workpiece held by the chuck with a transverse side surface in engagement with the chuck,
- wherein the first and second sets of workrests are configurable such that:
- when the outer circumferential surface of said workpiece is ground by a grinding wheel rotating in a grinding wheel rotation direction with the chuck rotating in a chuck rotation direction, the outer circumferential surface is only urged in contact with the first set of the first and second sets of workrests; and
- when an inner circumferential surface of said workpiece is ground by a grinding wheel rotating in the grinding wheel rotation direction, with the direction of rotation of the chuck reversed relative to the chuck rotation direction during grinding of the outer circumferential surface, the outer circumferential surface is only urged in contact with the second set of the first and second sets of workrests.

In this way, grinding forces generated during grinding of the outer and inner circumferential surfaces of the workpiece are resisted by respective separate sets of workrests. The assembly may thereby provide precise and robust restraint of the workpiece during each grind. Furthermore, this can be achieved without needing to remove the workpiece or reconfigure the grinding machine between the grinds, thereby minimising the time taken and improving the accuracy of the machining process.

This assembly configuration may be able to reliably constrain a workpiece against high grinding forces. Accordingly, it may enable both outer and inner circumferential surfaces to be ground using super-abrasive grinding wheels (such as wheels having a grinding surface comprising cubic boron nitride (CBN) material). High value-added, bespoke parts, that are made in small batches, benefit from the use of super-abrasive wheels which can be dressed with generic profiles (such as small radii) to follow generated paths or trajectories to finish the working surface of the part. High grinding ratios (that is, volumetric material removal/volumetric wheel loss) are also beneficial in small batch production with super-abrasive wheels.

The grinding of an inner circumferential surface, particularly with super-abrasive wheels, may generate much higher forces in a direction which might otherwise push the part away from workrests in known configurations, as the strength of a magnetic chuck may be insufficient to safely retain the workpiece.

In some implementations, the workrests of the first and second sets of workrests are located in the same positions relative to the chuck rotational axis during the steps of grinding the outer and inner circumferential surfaces of the workpiece. With this configuration, this grinding process is simplified as the workrest positions are fixed relative to the chuck rotational axis throughout grinding of the outer and inner circumferential surfaces of the workpiece.

At least one workrest of each of the first and second sets of workrests may be a movable workrest which is movable relative to the chuck rotational axis independently of the other workrests.

The workrests of at least one of the first and second sets of workrests may be movable workrests which are movable relative to the chuck rotational axis independently of the workrests of the other set. This allows the locations of the movable workrests to be adjusted as appropriate to suit different workpiece sizes and proportions, thereby providing a more versatile workpiece holding assembly. The extent to which the workpiece central axis is offset laterally from the chuck rotational axis may be altered as required for a given workpiece during a grinding operation. Also, this may enable the stability of the workpiece retention by the holding assembly to be improved. In preferred configurations, workrests of both of the first and second sets of workrests are movable workrests which are movable relative to the chuck rotational axis independently of the workrests of the other set.

Each movable workrest may be movable relative to the chuck rotational axis independently of the other workrests.

The location(s) of one or more movable workrests may be adjusted between different grinding operations. For example, the location(s) may be adjusted between the steps of grinding the outer and inner (or vice versa) circumferential surfaces of the workpiece.

Each of the workrests of at least one of the first and second sets of workrests may be coupled to the workpiece holding assembly via a (respective or shared) coupling which allows the workrests to be switched between predetermined advanced and retracted positions relative to the chuck rotational axis. A workrest (or set of workrests) may be coupled to the assembly by a respective mechanical coupling which may be operated under the control of a control system of the machine tool to switch the corresponding workrest (or set of workrests) between the two positions.

In some grinding procedures, the location(s) of one or both sets of workrests are adjusted between the steps of grinding the outer and inner (or vice versa) circumferential surfaces of the workpiece. For example, one of the sets may be retracted away from the chuck rotational axis or one of the sets may be advanced towards the chuck rotational axis. In a further example, one of the sets is retracted away from the chuck rotational axis and the other set is advanced towards the chuck rotational axis between the steps of grinding the outer and inner (or vice versa) circumferential surfaces of the workpiece.

Each movable workrest (or set of workrests) may be coupled to a respective workrest support, and a workrest actuator may be provided in association with each movable workrest (or set of workrests), with each workrest actuator operable to move the respective workrest (or set of workrests) relative to its workrest support. The location of each workrest support may be fixed and non-adjustable relative to a support structure of the workpiece holding assembly.

Each workrest actuator may be operable to switch the respective workrest (or set of workrests) between predefined advanced and retracted positions.

Each actuator may be configured to only facilitate switching of the respective workrest (or set of workrests) from one of the two positions to the other and vice versa, without enabling selection of other intermediate positions.

In some implementations, each workrest actuator is operable to move the respective workrest (or set of workrests) in a linear manner relative to its workrest support.

Each workrest actuator may be operable to move the respective workrest along a linear reference axis, each workrest actuator may include a drive assembly having a driven member which is coupled to the workrest, and the linear reference axis may extend through the driven member and the workrest.

Aligning the line of the force exerted by the drive assembly on the driven member with the workrest may provide a stiffer workrest actuator. The drive assembly may be hydraulically, pneumatically or electromagnetically actuated, for example.

Preferably, each workrest actuator includes a drive assembly having a driven member which is coupled to the workrest and is slideable relative to an actuator body between advanced and retracted positions. The driven member and actuator body may define complementary frustoconical surfaces which engage each other when the supporting member is in its advanced position. The frustoconical surfaces may taper inwardly in a direction towards the workrest. The complementary surfaces may provide a kinematic coupling between the driven member and the actuator body to ensure reliable and precise location of the respective workrest when it is in its advanced position.

A central reference axis of the frustoconical surfaces may be located so as to coincide with the linear reference axis. Alignment of the driven member, frustoconical surfaces and the workrest along a common linear reference axis results in a stiff and precise mechanism for translating the workrest and for holding the workrest in its advanced position.

Alternatively, each workrest actuator may be operable to move the respective workrest (or set of workrests) in a rotary manner relative to its workrest support.

In some preferred examples, each of the first and second sets of workrests consists of two workrests.

In one embodiment, the workpiece holding assembly may include four workrests only.

A first set of workrests (for use during grinding of an outer circumferential surface of a workpiece) may include one workrest at a location between 140 and 160° (preferably around 150°) from the circumferential position relative to the chuck rotational axis at which a grinding wheel contacts a workpiece held by the chuck (measured clockwise or anticlockwise). The second set may include another workrest at a location between 50 and 70° (preferably around 60°) from the circumferential position relative to the chuck rotational axis at which a grinding wheel contacts a workpiece held by the chuck (measured clockwise or anticlockwise, but in the same sense as the one workrest).

A second set of workrests (for use during grinding of an inner circumferential surface of a workpiece) may include a workrest at a location between 170 and 190° (preferably around 180°) from the circumferential position relative to the chuck rotational axis at which a grinding wheel in use contacts a workpiece held by the chuck. The second set may include another workrest at a location between 80 and 100° (preferably around 90°) from the circumferential position relative to the chuck rotational axis at which a grinding wheel contacts a workpiece held by the chuck (measured clockwise or anticlockwise).

The magnetic chuck may define a chuck engagement plane for engaging with a planar surface of a workpiece. The locations of the workrests relative to the magnetic chuck may be adjustable and individually fixed in selected positions.

The present invention further provides a grinding machine including a machine base and a workpiece holding assembly as described herein which is carried by the machine base. The machine may include a grinding wheel drive for rotating a grinding wheel about a grinding wheel axis, wherein the grinding wheel axis is at substantially the same height above the machine base as the chuck rotational axis.

The grinding machine may include a grinding wheel having a grinding surface comprising CBN material.

The present invention also provides a method of grinding a workpiece having an outer circumferential surface and an inner circumferential surface using a workpiece holding assembly as described herein to hold the workpiece, the method comprising the steps of:

rotating the workpiece in a first workpiece rotation direction during grinding of the outer circumferential surface with a grinding wheel rotating in a grinding wheel rotation direction; and rotating the workpiece in a second workpiece rotation direction opposite to the first workpiece rotation direction during grinding of the inner circumferential surface, with the grinding wheel rotating in the grinding wheel rotation direction.

In some embodiments, the grinding wheel rotates in a direction opposite to the first workpiece rotation direction during grinding of the outer circumferential surface, and the grinding wheel rotates in the same direction as the first workpiece rotation direction during grinding of the inner circumferential surface. In this way, climb grinding may be carried out, with the workpiece and grinding wheel surfaces moving in the same direction.

In further embodiments, the grinding wheel rotates in the same direction as the first workpiece rotation direction during grinding of the outer circumferential surface, and the grinding wheel rotates in a direction opposite to the first workpiece rotation direction during grinding of the inner circumferential surface. In this way, an up-cutting grinding process may be carried out, with the workpiece and grinding wheel surfaces moving in opposite directions.

Further combinations of grinding wheel and workpiece rotational directions may be implemented. The location of the point of contact between a grinding wheel and the workpiece may also be adjusted in a circumferential direction around the workpiece to improve the reliability of retention of a workpiece by the workpiece holding assembly.

Each workrest may have a workpiece engagement surface which is radially spaced (offset) from a locus defined by the outer circumferential surface of the workpiece when the workpiece is located with the workpiece central axis coaxial with the chuck rotational axis. These offsets may be selected to allow a workpiece to move clear of one set of workrests when moved into engagement with another set of workrests.

The workrests of the first set may be offset such that when the workpiece is engaged with the workrests of the first set and the chuck rotates in a chuck rotation direction, a resultant force is exerted on the workpiece which urges it towards the first set of workrests. The workrests of the second set may be offset such that when the workpiece is engaged with the workrests of the second set and the chuck rotates in a direction opposite to said chuck rotation direction, a resultant force is exerted on the workpiece which urges it towards the second set of workrests.

The workrests of the first and second sets of workrests may be located in the same positions relative to the chuck during the steps of grinding the outer and inner circumferential surfaces of the workpiece.

Alternatively, the workrests of at least one of the first and second sets of workrests may be located in different positions relative to the chuck during the steps of grinding the outer and inner circumferential surfaces of the workpiece, respectively.

The assembly and methods described herein may be suitable for use in grinding a range of workpieces having inner and outer circumferential surfaces which have a circular cross-section in a plane perpendicular to the workpiece central axis. For example, the workpieces may be in the form of a thin ring or sleeve, such as a bearing raceway of a rolling element bearing. The outer circumferential surface may be radially outwardly facing relative to the workpiece central axis. The inner circumferential surface may be radially inwardly facing relative to the workpiece central axis.

BRIEF DESCRIPTION OF THE DRAWINGS

Embodiments of the invention will now be described by way of example and with reference to the accompanying schematic drawings, wherein.

DETAILED DESCRIPTION OF THE DRAWINGS

Figure 1:
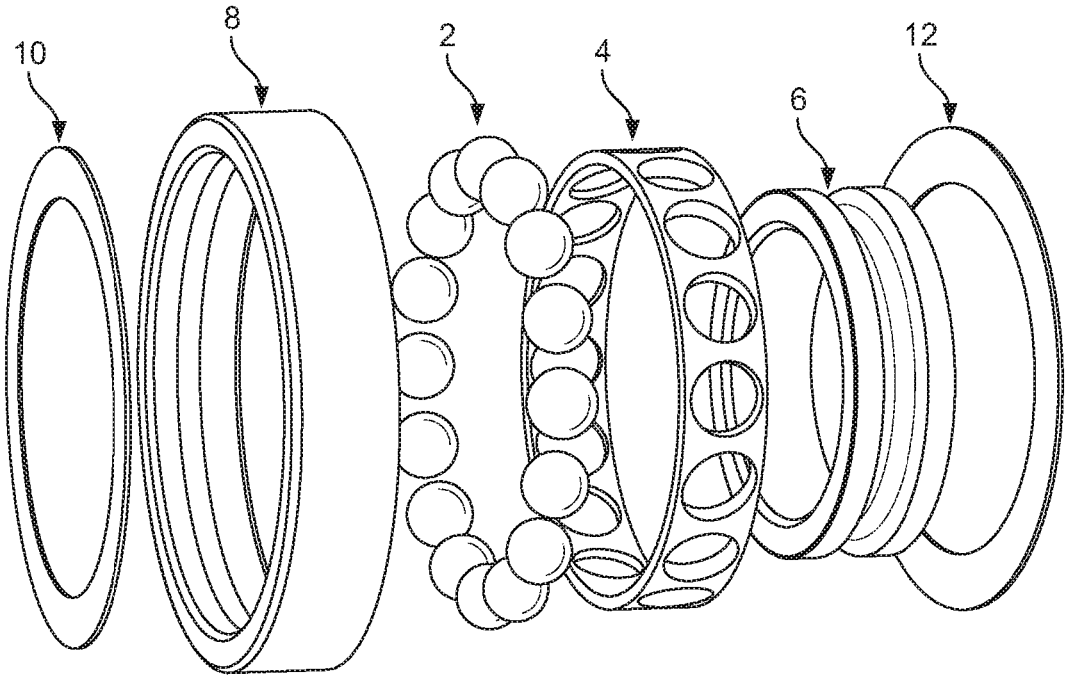
FIG. 1 is an exploded perspective view of components of a known rolling element bearing.

Components of a known rolling element bearing are shown in FIG. 1. In the assembled bearing, the location of the bearings 2 is constrained by a cage 4. The bearings roll around an inner race 6 and within an outer race 8. Seals 10 and 12 are located on opposite sides of the bearings. High dimensional accuracy of the finished races 6 and 8 in terms of the surface finishes, roundness and concentricity of the inner and outer circumferential surfaces is desirable to minimise vibration and heat generation. The time taken to machine both inner and outer circumferential surfaces may be minimised if both surfaces can be machined without having to transfer the workpiece to another machine after grinding one surface in order to grind the other.

Figure 2:
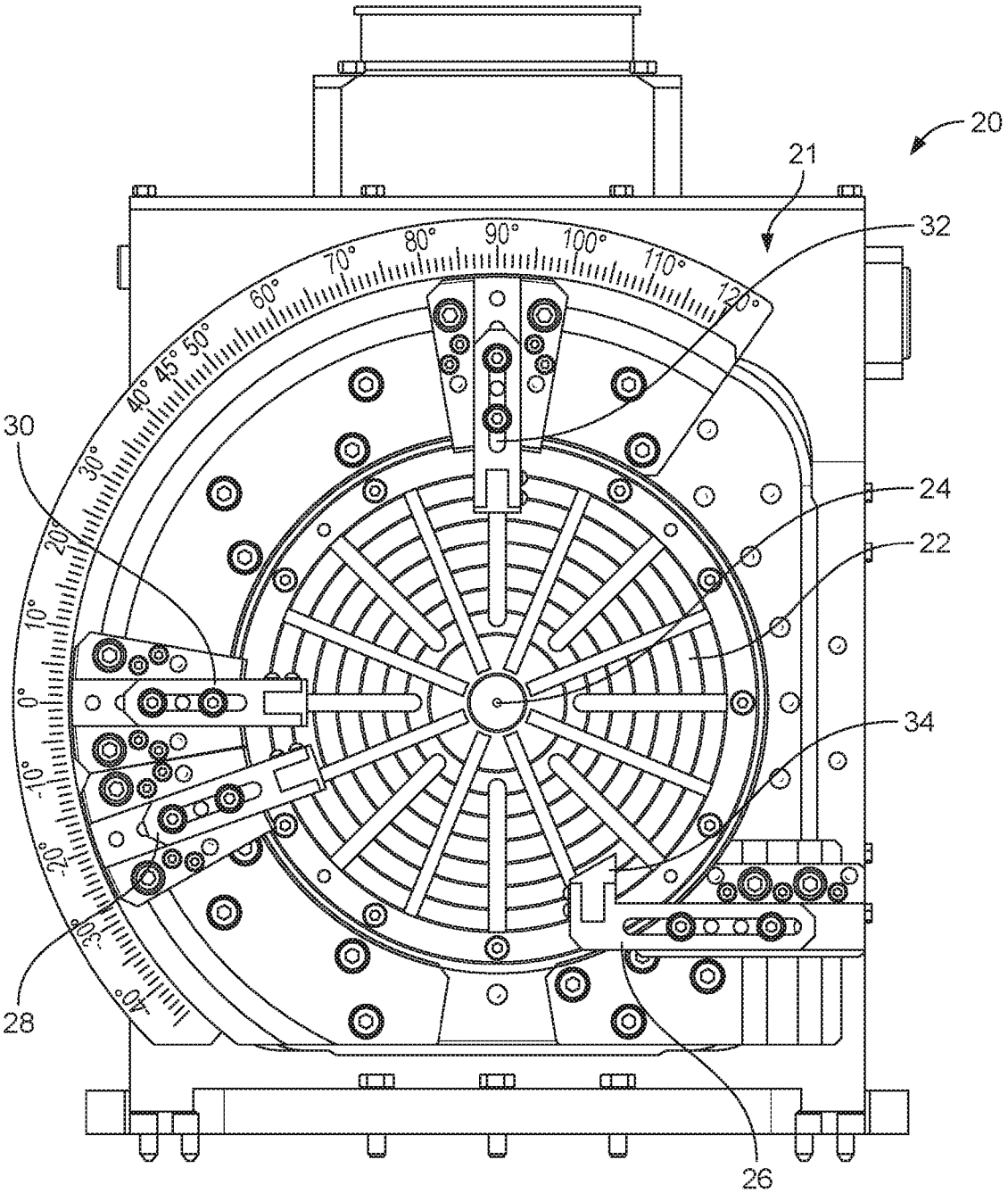
FIG. 2 is a side view of a workpiece holding assembly according to an embodiment of the invention.

A workpiece holding assembly 20 according to an embodiment of the invention is shown in FIG. 2. It includes a magnetic chuck 22 and a drive (not shown) for rotating the chuck about a chuck rotational axis 24 which is perpendicular to the plane of the drawing. The magnetic chuck drive is carried by an assembly body 21 which provides a support structure for the assembly. In use the assembly body is mounted onto a machine base of a machine tool (not shown).

Figure 3:
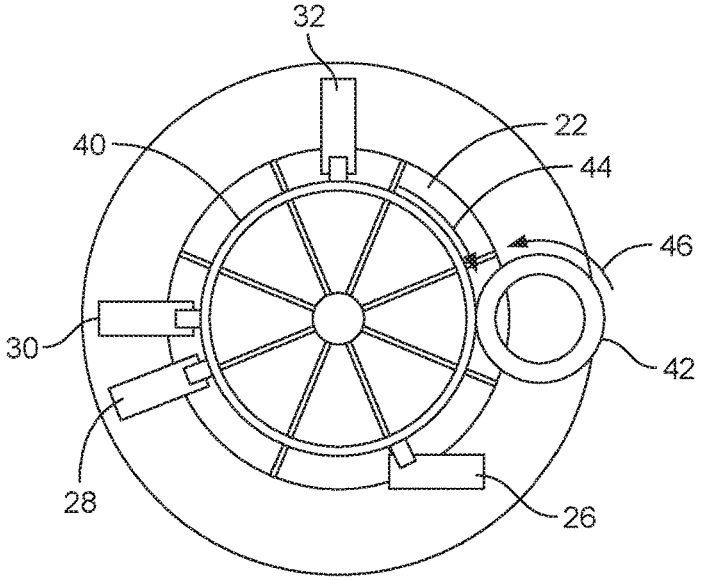
FIGS. 3 and 4 are diagrams representing side views of a workpiece holding assembly according to an embodiment of the invention when grinding an outer and an inner circumferential surface, respectively, of an annular workpiece.
Figure 4:
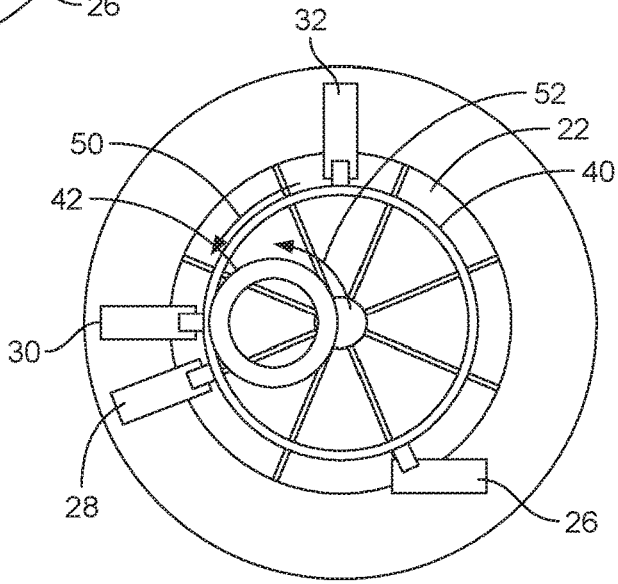

FIGS. 3 and 4 schematically illustrate grinding of an annular workpiece 40 using a grinding wheel 42.

A first set of workrests comprises first and second lower workrests 26, 28 and a second set of workrests comprises first and second upper workrests 30, 32. The workrests may be in the form of finger supports. They may be selectively fixed in position relative to the magnetic chuck. Each workrest may include an adjustable slide to facilitate fine adjustment of the location of the workpiece engagement surface of each workrest relative to the magnetic chuck.

In the configuration shown in FIG. 2, the workrests are arranged such that the location of workrest 26 is adjustable by its slide in a horizontal direction (that is, parallel to the reference plane of the machine base). The workrests 28, 30 and 32 are adjustable using their respective slides in radial directions relative to the chuck rotational axis.

A first set of workrests comprises two lower workrests which are lower than the chuck rotational axis in use when the workpiece holding assembly is mounted on a grinding machine. Preferably, the first lower workrest 26 is located at a radial position relative to the chuck rotational axis 24 which is in a range of 120 to 180° measured in a circumferential direction from a vertical reference line extending from the chuck rotational axis. Preferably, the first lower workrest is located at a radial position around 150° from the vertical reference line.

Preferably, the second lower workrest 28 is located at a radial position relative to the chuck rotational axis which is in a range of 210 to 270° measured in the same circumferential direction from a vertical reference line extending from the chuck rotational axis. The second lower workrest may be located at a radial position around 240° from the reference line.

The second set of workrests comprises two upper workrests 30, 32 which in use are higher than the two lower workrests.

Preferably, the first upper workrest 30 is located at a radial position relative to the chuck rotational axis which is in a range of 240 to 300° measured in the same circumferential direction from a vertical reference line extending from the chuck rotational axis. More particularly, the first workrest may be located at a radial position around 270° from the vertical reference line.

Preferably, the second upper workrest 32 is located at a radial position relative to the chuck rotational axis which is in a range of 330 to 30° measured in the same circumferential direction from a vertical reference line extending from the chuck rotational axis. More preferably, the second upper workrest may be located at a radial position around the vertical reference line.

The lower workrests may be located at approximately 5 o'clock and 8 o'clock relative to the magnetic chuck rotational axis 24. The pair of upper workrests may be located at approximately 9 o'clock and 12 o'clock relative to the magnetic chuck. It will be appreciated that the radial orientations of the workrests may alternatively correspond to these positions when reflected through vertical or horizontal planes of symmetry passing through the chuck rotational axis.

Each workrest may include a tip or shoe in the form of a wear resistant insert 34 to provide a workpiece engagement surface. The inserts may be formed of tungsten carbide or another material of similar physical properties, such as a ceramic material, polycrystalline diamond, or hard coated steel. When fixed in position, the workrests may allow a degree of rocking motion of their tips relative to the magnetic chuck.

In use of the assembly, the workrests are adjusted relative to the magnetic chuck so that their workpiece engagement surfaces or tips are offset radially from a locus defined by the outer circumferential surface of a workpiece to be ground when its central axis is coaxial with the chuck rotational axis, by 0.6 to 0.8 mm for example. To achieve this, a master part, ground to the finished size, may be gripped centrally with respect to the chuck rotational axis 24 by the magnetic chuck and then offset to a position which will define the workrest settings. The clamps on the adjustment slides for the lower pair of workrests are loosened to allow movement of their tips until they touch the offset master part. Once the lower pair of tips is set to be in contact with the part, the adjustment slides are clamped firmly in place. A similar operation is performed for the upper pair of workrests using a slightly modified offset position for the master part.

A workpiece is then loaded approximately centrally within the four workrests and gripped by the magnetic chuck. The workpiece 40 is loaded into a position where its central axis is displaced slightly from the chuck rotational axis 24 in a direction generally towards the pair of workrests to be contacted in the next grinding operation. The magnetic chuck drive is then set to rotate the magnetic chuck in a direction dependent on the subsequent grinding operation. The workpiece is caused to move across the face of the chuck against the magnetic holding force by the centrifugal action on the offset workpiece, and into contact with one of the pairs of workrest shoes in preparation for a rotating grinding wheel to be brought into contact with the workpiece. The workpiece is further caused to be secured in contact with the pair of workrests by grinding forces exerted on the workpiece by the grinding wheel.

In the grinding operation, the grinding wheel may be brought into contact with an outer circumferential surface of a workpiece. In another grinding operation on the workpiece, the grinding wheel may be brought into contact with an inner circumferential surface of the workpiece. By reversing the direction of rotation of the chuck in one of these grinding operations relative to the other (and not reversing the direction of rotation of the grinding wheel), the workpiece is urged into contact with a different set of workrests in each grinding operation.

The workrests may be configured such that reversing the direction of rotation of the chuck causes the workpiece to move from one set of workrests to the other automatically between grinds, without requiring any other intervention. This may simplify the process of switching between grinding the inner and outer surfaces of the workpiece and reduce the time taken to switch between the two grinds.

In the implementation shown in FIG. 3, the grinding wheel is machining an outer circumferential surface of the workpiece. The workpiece is rotated clockwise by the magnetic chuck 22 as indicated by arrow 44. The grinding wheel 42 is rotated anti-clockwise as indicated by arrow 46. The workpiece is urged into contact with the lower workrests 26 and 28. A grinding force is created during material removal by locating the central axis of the grinding wheel above that of the workpiece. This urges the workpiece towards the lower workrests. In this example, the workpiece is machined by climb grinding, with the workpiece and wheel surfaces moving in the same direction.

FIG. 4 illustrates an operation to grind an inner circumferential surface of the workpiece 40. The workpiece is rotated anti-clockwise (when viewed in FIG. 4) as indicated by arrow 50 so as to cause the workpiece to be moved into contact with the workrests 30 and 32. The grinding wheel 42 is brought into contact with the inner circumferential surface of the workpiece. It is located on the opposite side of the workpiece in the radial direction to the workrest 30. The grinding wheel is rotated anti-clockwise as indicated by arrow 52. The central axis of the grinding wheel is located below that of the workpiece which urges the workpiece into engagement with the workrests 30 and 32. The inner circumferential surface is ground by climb grinding, with the workpiece and wheel surfaces moving in the same direction.

The inner circumferential surface may instead be ground before the outer circumferential surface. Once both surfaces have been ground to their finished size and finish, the workpiece can be released from the magnetic chuck and removed by an unloading mechanism. In other implementations, the inner and outer circumferential surfaces of a workpiece may be ground by up-cutting, with the workpiece and wheel surfaces moving in opposite directions.

Figure 5:
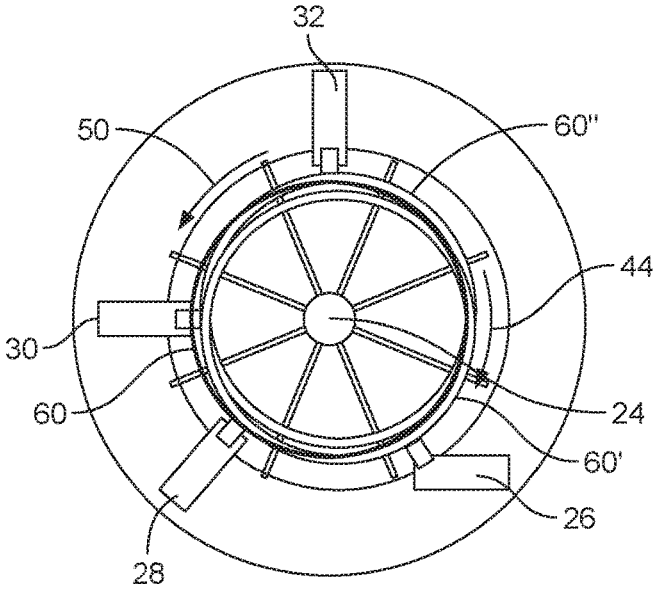
FIG. 5 is a diagram representing a side view of a workpiece holding assembly according to an embodiment of the invention to illustrate offset locations of a workpiece when engaged with either the lower or upper pairs of workrests.

Displacement of a workpiece across the face of a chuck between two sets of workrests is illustrated in FIG. 5. Circle 60 indicates the location occupied by the workpiece when its central axis is coincident with the chuck rotational axis 24. When grinding the outer circumferential surface, the workpiece is rotated clockwise by the chuck and is in contact with the lower set of workrests 26 and 28. In this location, it is displaced from the position of circle 60 to the position of circle 60' (in a radial direction corresponding to around 4 o'clock relative to the central axis of the chuck when viewed as shown in FIG. 5). When grinding the inner circumferential surface, the workpiece is rotated anti-clockwise and is in contact with the upper set of workrests 30 and 32. In this location, it is displaced from the position of circle 60 to the position of circle 60" (in a radial direction corresponding to around 2 o'clock relative to the central axis of the chuck when viewed as shown in FIG. 5). These offsets cause the workpiece to be urged towards the respective sets of workpieces when the chuck is rotated as indicated above.

It has been found that both the inner and outer circumferential surfaces of many workpieces may be ground using a workpiece holding assembly as described herein using a single set-up for the workrests. In these circumstances, the position of the workrests can be fixed initially and then grinding of both the inner and outer circumferential surfaces can be carried out without changing the locations of the workrests.

With some workpiece geometries however, it may be possible for the workrest locations desired for one or both of the inner and outer grinds to interfere with the workpiece location intended for the other grind. This issue is illustrated in FIGS. 6 and 7.

Figure 6:
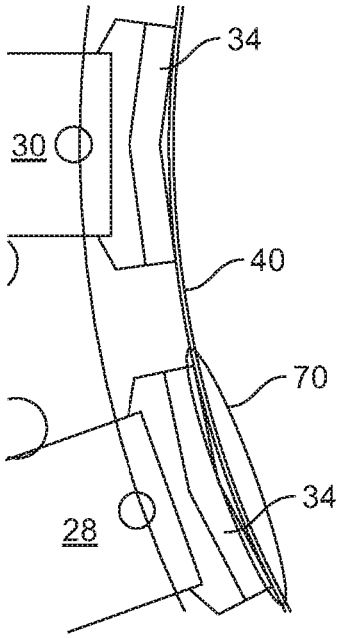
FIGS. 6 and 7 are diagrams to illustrate the possibility of interference of a workrest with a grinding set-up.

In FIG. 6, workpiece 40 is shown in the location intended for grinding of its inner circumferential surface. In order to carry out this grind, it is supported by the upper workrests 30 and 32. However, in the region 70 marked in the drawing, it can be seen that the lower workrest 28 (in the position desired during grinding the outer circumferential surface of the workpiece) interferes with the desired intended positioning of the workpiece.

Figure 7:
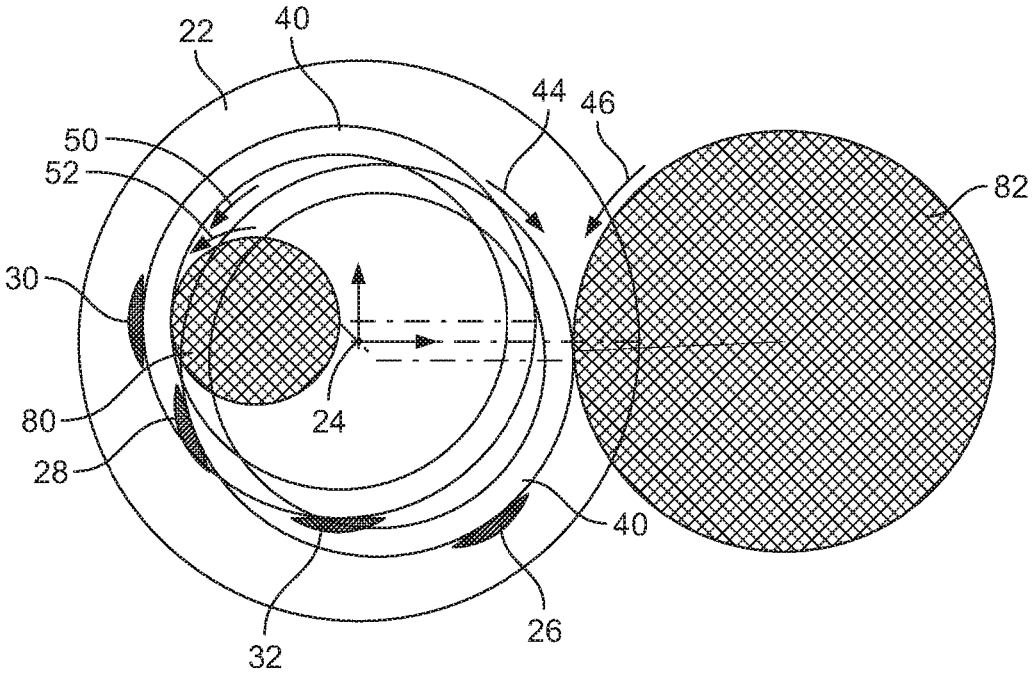

Other circumstances under which this issue may arise are shown in FIG. 7. The workrest configuration depicted in the schematic drawing of FIG. 7 differs from that of preceding drawings in that workrest 32 of the first set of workrests is in a location diametrically opposite to that shown in preceding drawings. A workpiece 40 is shown in two offset locations desired during grinding of its inner and outer circumferential surfaces. These offsets and the associated displacements of the workrests are exaggerated in this drawing for the purposes of illustration. In practice, the offsets may be very small. It can be seen that when workpiece 40 is in engagement with workrests 30 and 32 during grinding of its inner circumferential surface by grinding wheel 80, workrest 28 interferes with its desired location. Similarly, with the workpiece in engagement with workrests 26 and 28 or grinding of its outer circumferential surface by the grinding wheel 82, workrest 32 of the other set interferes with the desired position for the workpiece.

To address the interference issue described with reference to FIGS. 6 and 7, a workpiece holding assembly according to the present disclosure may include one or more workrests which are switchable between advanced and retracted positions. Thus, a workrest can be held in its advanced position during a grind when it is intended to engage the workpiece and then switch to its retracted position when it is intended to be clear of the workpiece. The magnitude of the displacement needed between the advanced and retracted positions may be less than a millimetre, for example.

Figure 8:
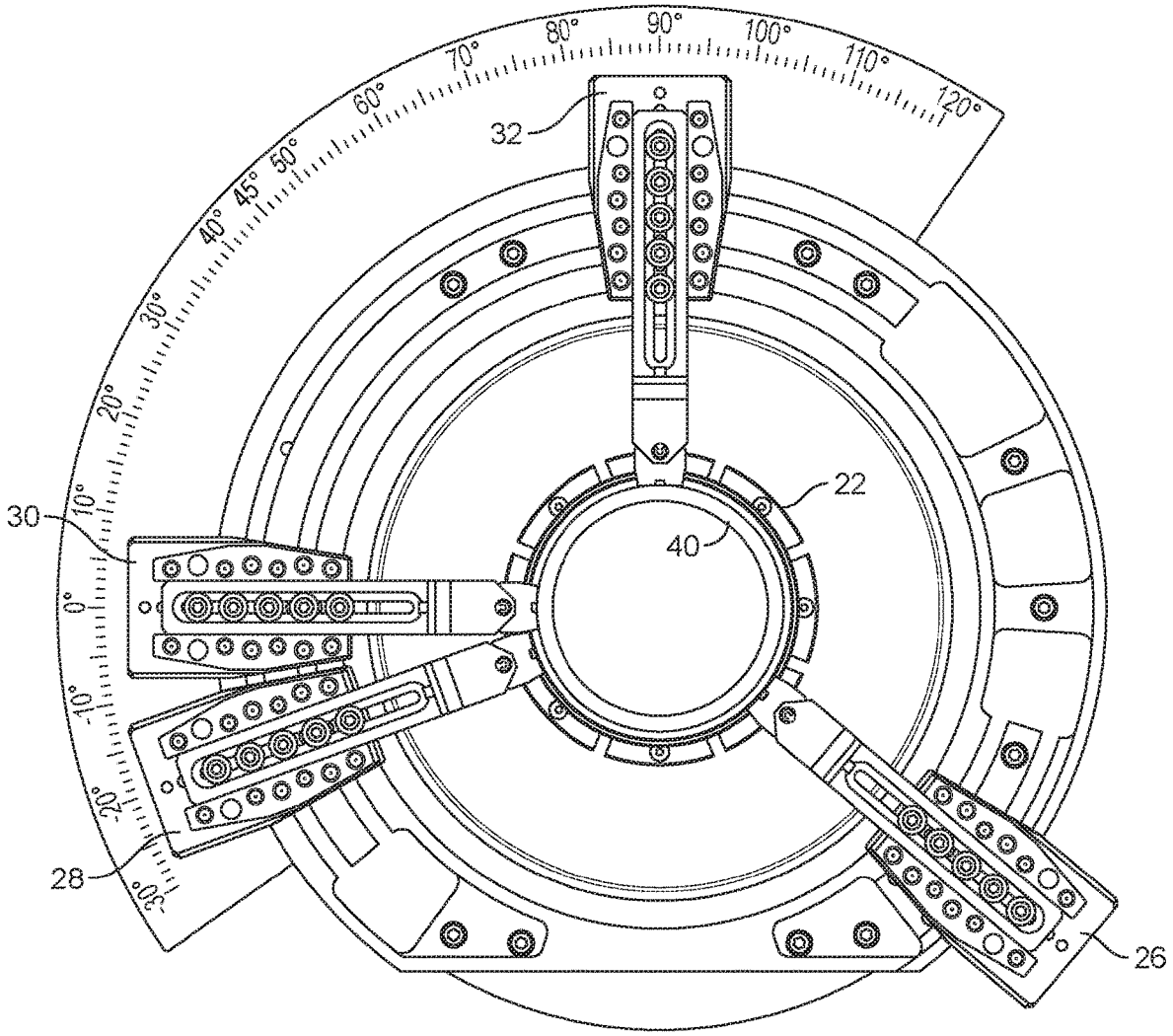
FIGS. 8 and 9 are side views of two different configurations of a workpiece holding assembly according to an embodiment of the invention.
Figure 9:
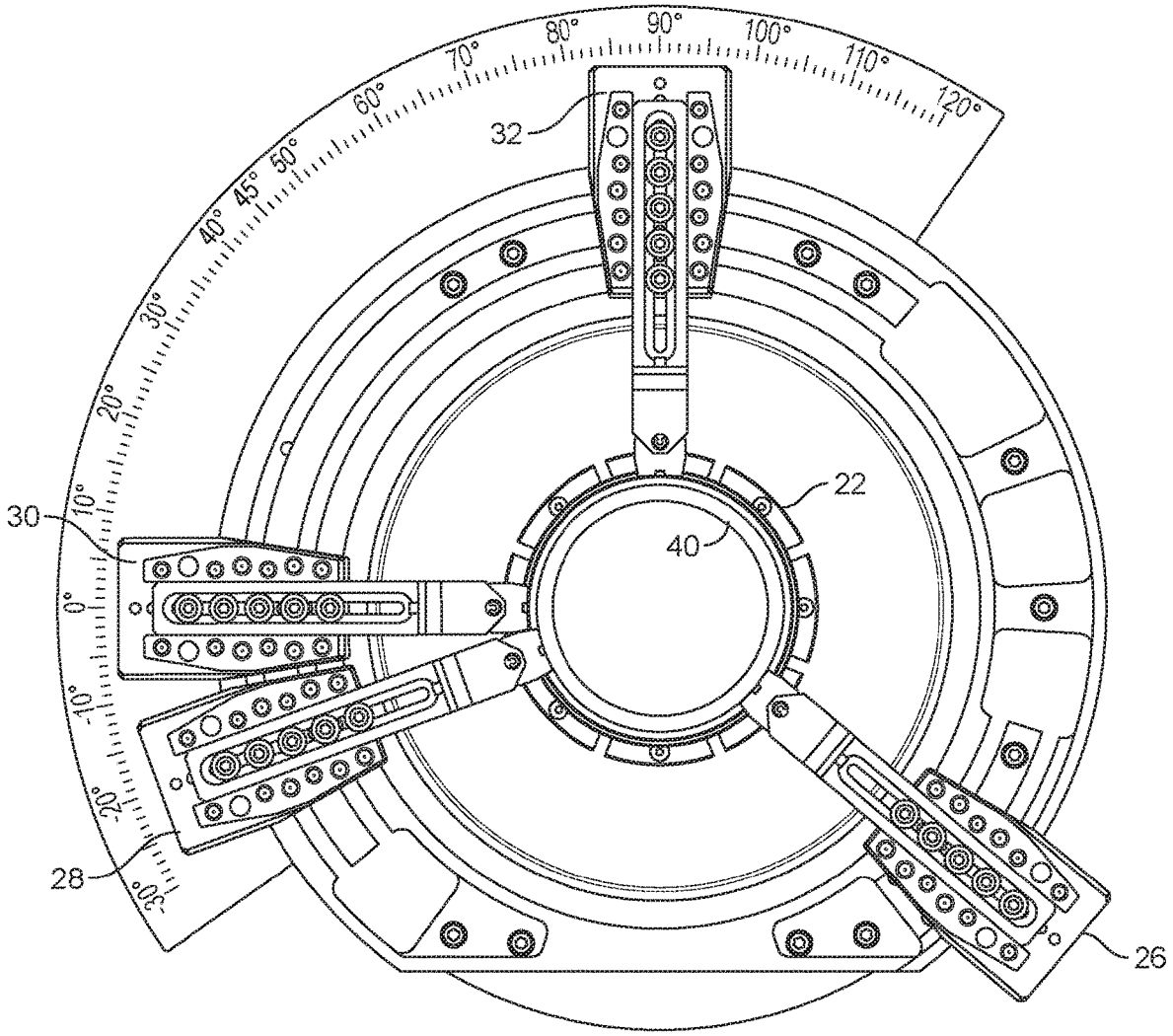

FIGS. 8 and 9 show a workpiece holding assembly with its workrests in two different configurations. In FIG. 8, the workrests are in a configuration suitable for holding a workpiece 40 during grinding of its inner circumferential surface. Workrests 30 and 32 are in their advanced positions and in contact with the workpiece. Workrests 26 and 28 are in their retracted positions, spaced from the outer circumferential surface of the workpiece (by around 6 mm in this example). In FIG. 9, the workrests are in a configuration suitable for holding the workpiece 40 during grinding of its outer circumferential surface. In this case, workrests 30 and 32 are in their retracted positions, spaced from the outer circumferential surface workpiece (by around 6 mm in this example). Workrests 26 and 28 are in their advanced positions and in contact with the workpiece.

Figure 10:
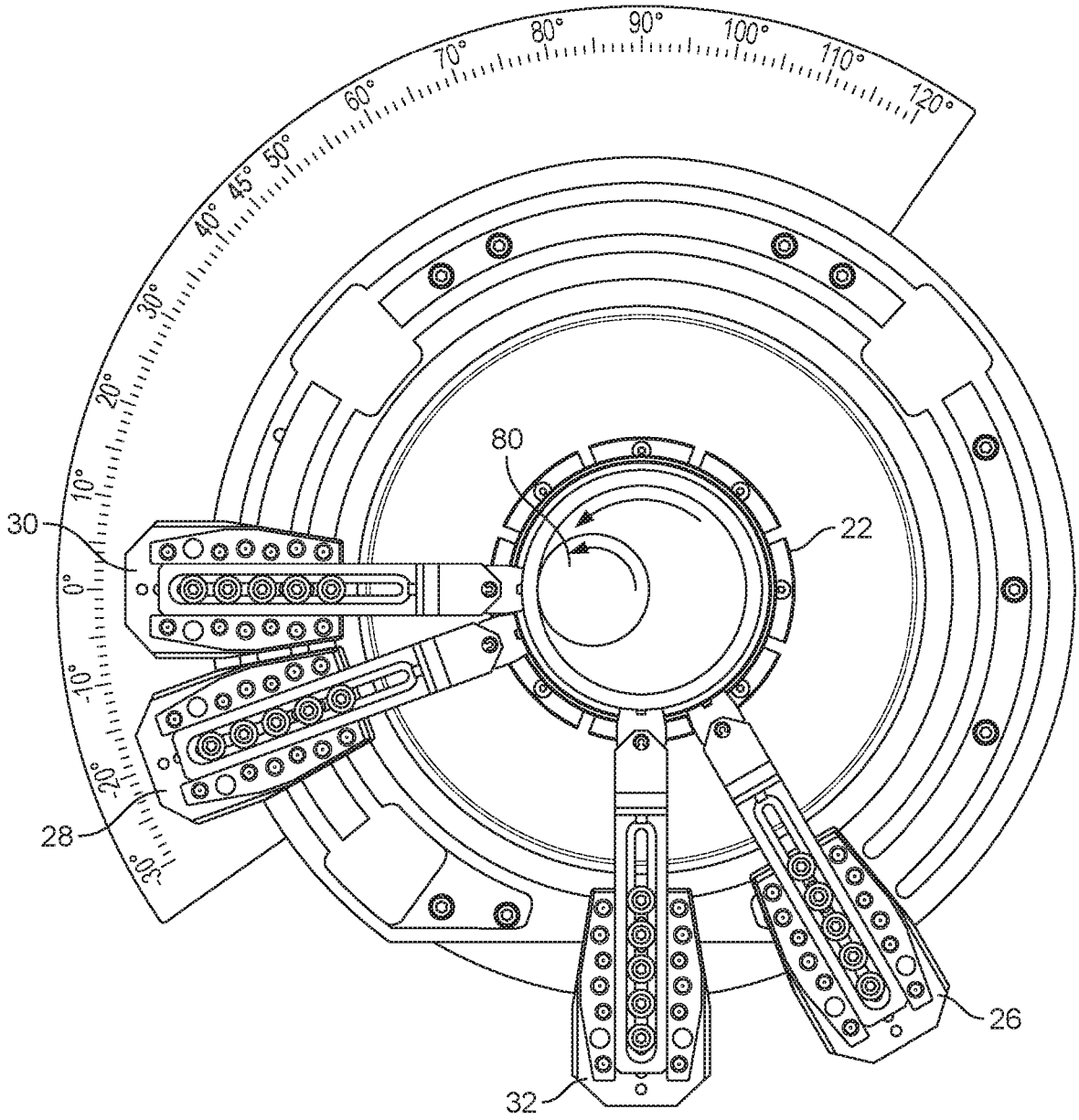
FIGS. 10 and 11 are side views of two further, different configurations of a workpiece holding assembly according to an embodiment of the invention.
Figure 11:
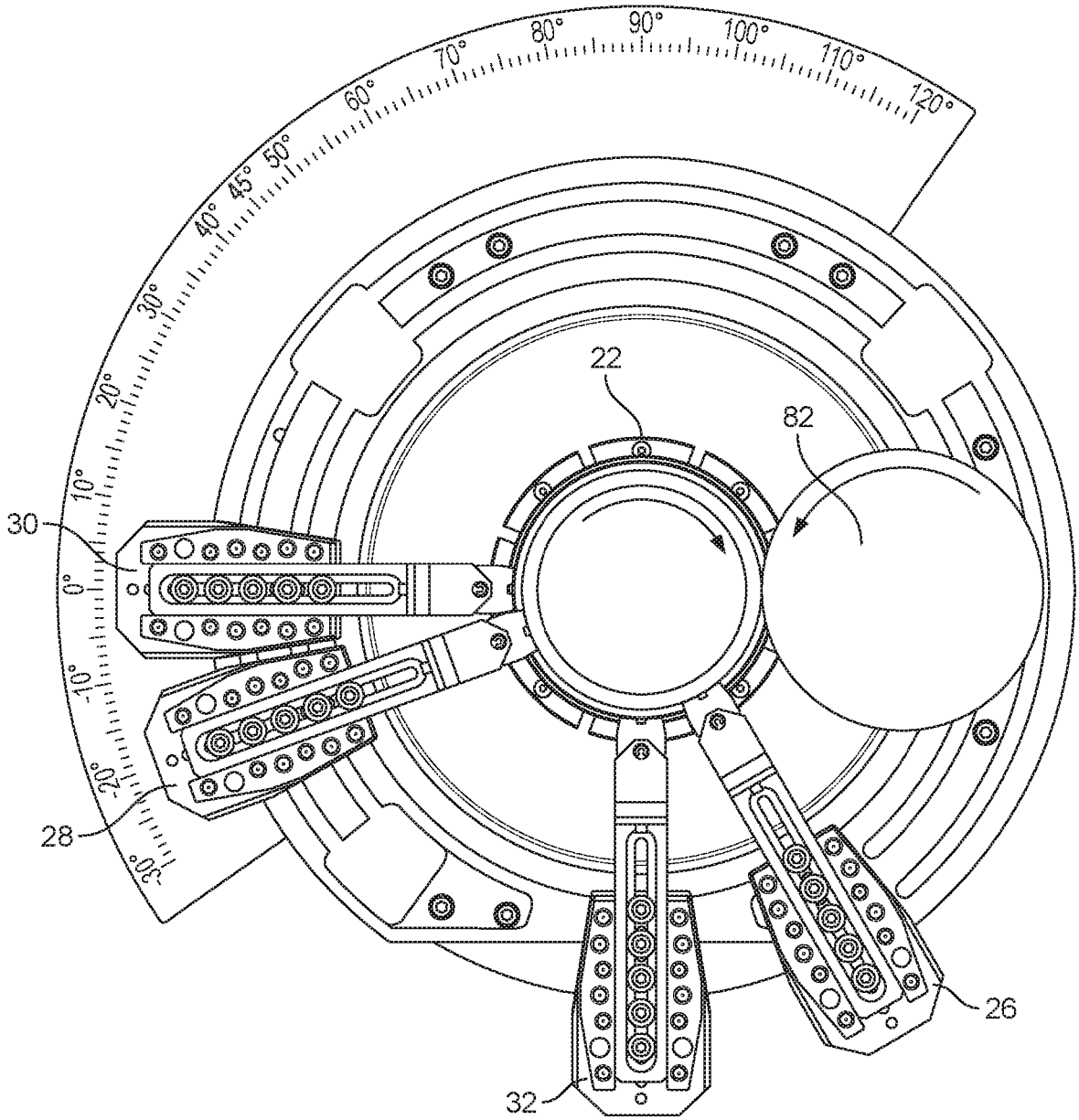

FIGS. 10 and 11 show a workpiece holding assembly with its workrests in two different configurations, in a similar manner to FIGS. 8 and 9. In the examples of FIGS. 10 and 11, workrest 32 is shown in an alternative location, diametrically opposed to that in FIGS. 8 and 9. In each of the configurations shown in FIGS. 10 and 11, the central axis of the grinding wheel is preferably located above that of the workpiece so as to drive the workpiece towards the respective workrests. The directions of rotation for the grinding wheel and chuck shown in these Figures result in climb grinding of the workpiece. The direction of rotation of the wheel or the chuck may be reversed to carry out up-cutting grinding.

Figure 12:
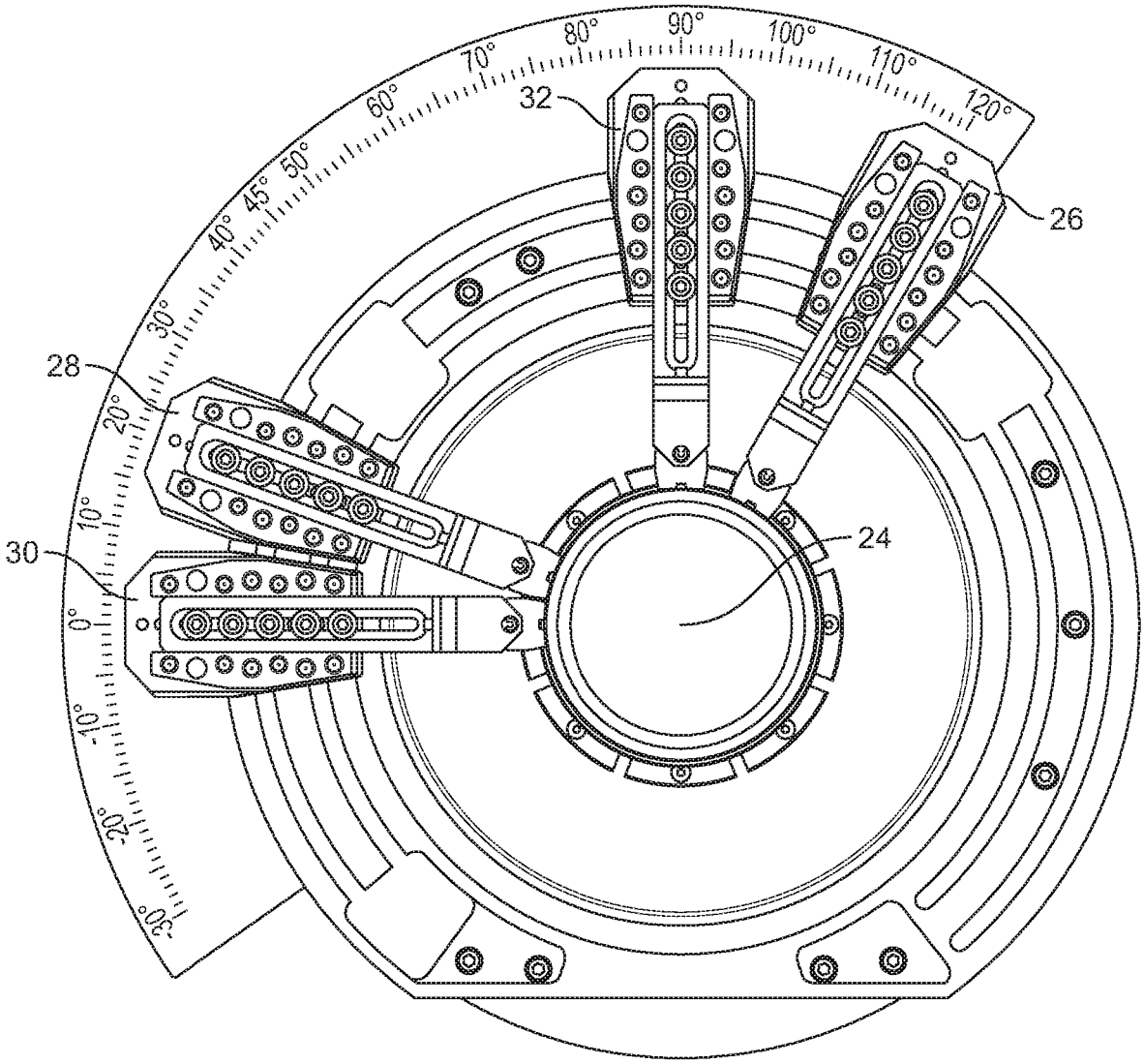
FIGS. 12 and 13 are side views of two alternative workrest configurations of a workpiece holding assembly according to an embodiment of the invention.
Figure 13:
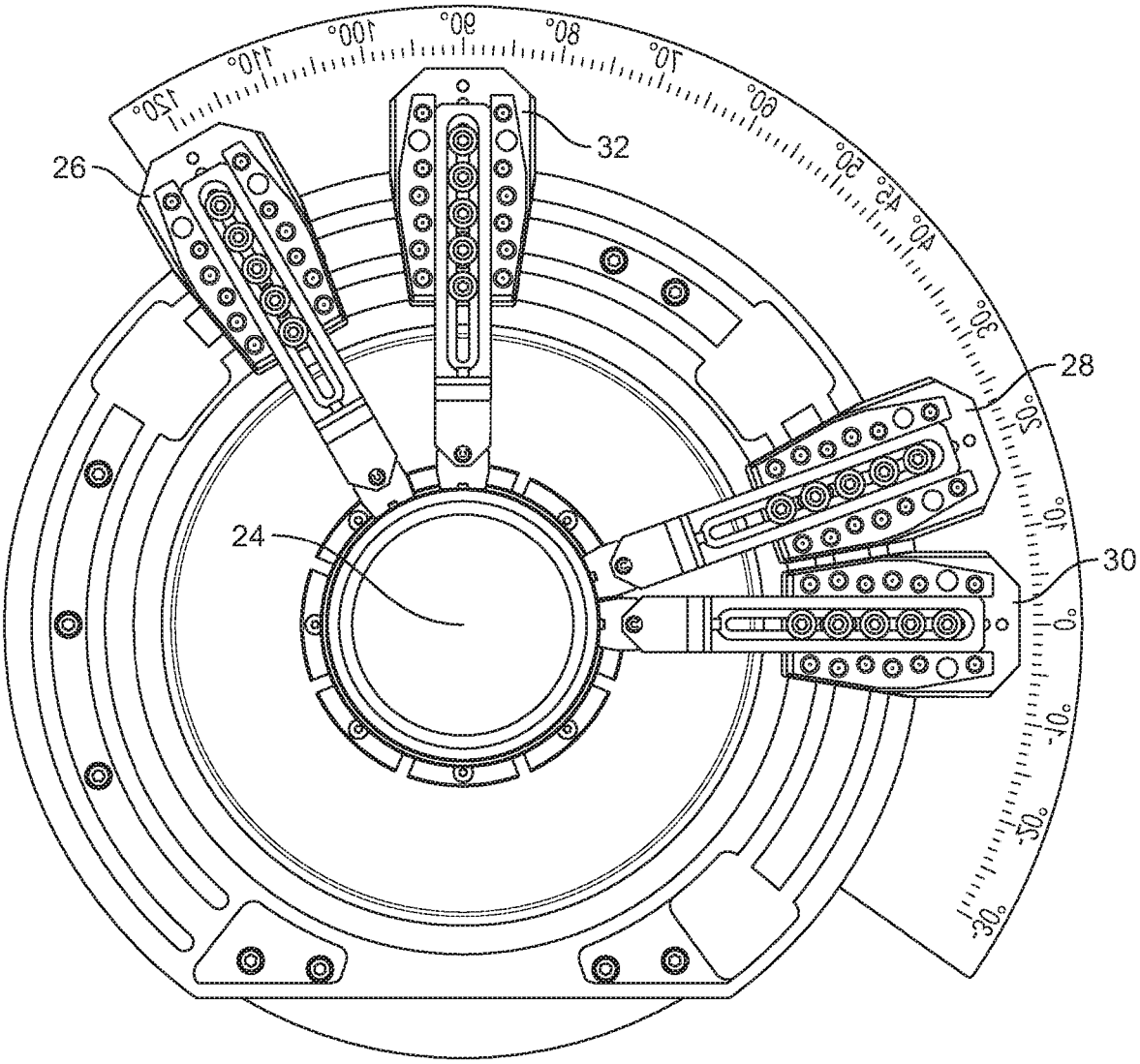

Further workpiece holding assemblies are shown in FIGS. 12 and 13 to illustrate other variations in the circumferential arrangement of the workrests which are also suitable for supporting a workpiece during grinding of its inner and outer circumferential surfaces. The arrangement shown in FIG. 12 corresponds to that of FIG. 10 when reflected in a horizontal plane extending through the chuck rotational axis 24. The arrangement shown in FIG. 13 corresponds to that of FIG. 12 when reflected in a vertical plane extending through the chuck rotational axis 24. The arrangements of FIGS. 12 and 13 may be preferable in machine tool configurations where it would be advantageous to locate the workrests away from the lower region of the workpiece holding assembly, for example to avoid conflict with other parts of the machine tool.

In each of the configurations shown in FIGS. 12 and 13, the central axis of the grinding wheel is preferably located below that of the workpiece during grinding of both the inner and outer surfaces of the workpiece, so as to drive the workpiece towards the respective workrests during each grind. The grinding wheel moves right to left to grind the workpiece in FIG. 12 and left to right in FIG. 13.

The direction in which a workpiece central axis is offset from the magnetic chuck rotational axis during grinding, together with the direction of rotation of the chuck, determines the direction of the resultant force on the workpiece during grinding. If the chuck is rotated clockwise (when viewed from the workpiece mounting side), a workpiece offset to the right leads to a downward force, a workpiece offset to the left leads to an upward force, an upward offset leads to a force to the right, and a downward offset leads to a force to the left. If the chuck is rotated anti-clockwise (when viewed from the workpiece mounting side), a workpiece offset to the left leads to a downward force, a workpiece offset to the right leads to an upward force, an upward offset leads to a force to the left, and a downward offset leads to a force to the right. The workrests of each set may be positioned as appropriate to correspond to the desired offset and counteract the associated resultant force on the workpiece.

In FIG. 12, during grinding of the inner surface of the workpiece, clockwise rotation of the chuck in combination with a workpiece offset down and to the left causes the workpiece to be driven towards the pair of workrests 30 and 32. During grinding of the outer surface of the workpiece, anticlockwise rotation of the chuck in combination with a workpiece offset up and to the right causes the workpiece to be driven towards the pair of workrests 26 and 28.

In FIG. 13, during grinding of the inner surface of the workpiece, anticlockwise rotation of the chuck in combination with a workpiece offset down and to the right causes the workpiece to be driven towards the pair of workrests 30 and 32. During grinding of the outer surface of the workpiece, clockwise rotation of the chuck in combination with a workpiece offset up and to the left causes the workpiece to be driven towards the pair of workrests 26 and 28.

Figure 14:
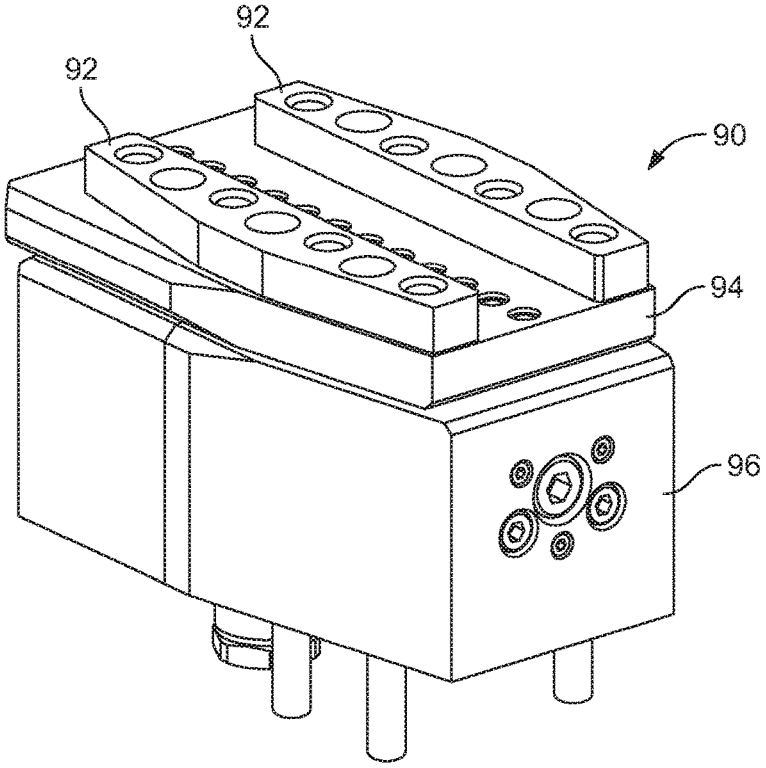
FIGS. 14 and 15 are perspective and side cross-sectional views, respectively, of a linear workrest actuation assembly.
Figure 15:
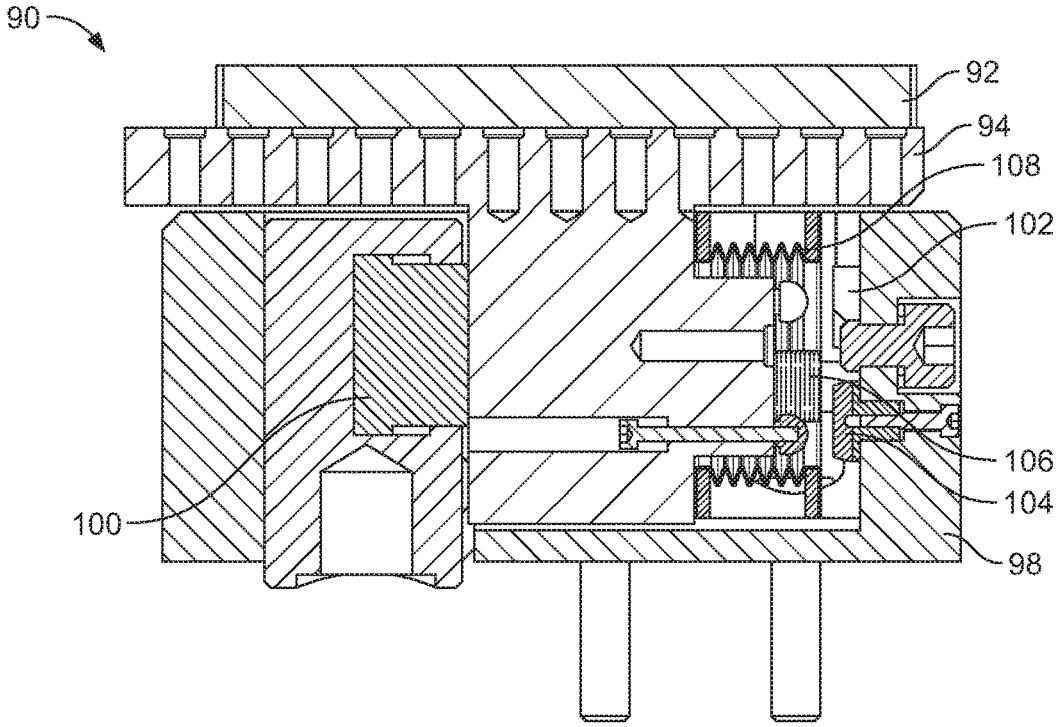

FIGS. 14 and 15 depict a workrest actuation assembly 90 for mechanically switching a workrest in a linear direction between advanced and retracted positions. The assembly includes a pair of shoe arm clamp blocks 92 for clamping a workrest finger (not shown) therebetween. The shoe arm clamp blocks are mounted on a supporting member 94. An actuator housing 96 contains an actuation mechanism for moving the supporting member 94 relative to it. The actuator housing includes a lower carriage 98 for fixing to a supporting surface of a workpiece holding assembly. A hydraulic piston 100 is provided to drive the supporting member 94 relative to the lower carriage 98. The piston may be able to exert a force of up to 5 tonnes, for example, to reliably hold the associated workrest in its advanced position during grinding.

The actuation assembly is shown in FIGS. 14 and 15 in a configuration corresponding to a retracted workrest position. The piston 100 is operable to drive the supporting member 94 towards the right-hand side of FIG. 15 into a configuration corresponding to an advanced workrest position. The actuation mechanism includes a device to precisely locate the supporting member 94 in its advanced position relative to the lower carriage 98. For example, this device may be in the form of a kinematic mounting 102. One or more further kinematic mountings 104 may also be included. The kinematic mountings may be in the form of 3V kinematic mountings for example. The piston acts against a return spring 106. The kinematic mountings and the spring are surrounded by a bellows 108.

Figure 16:
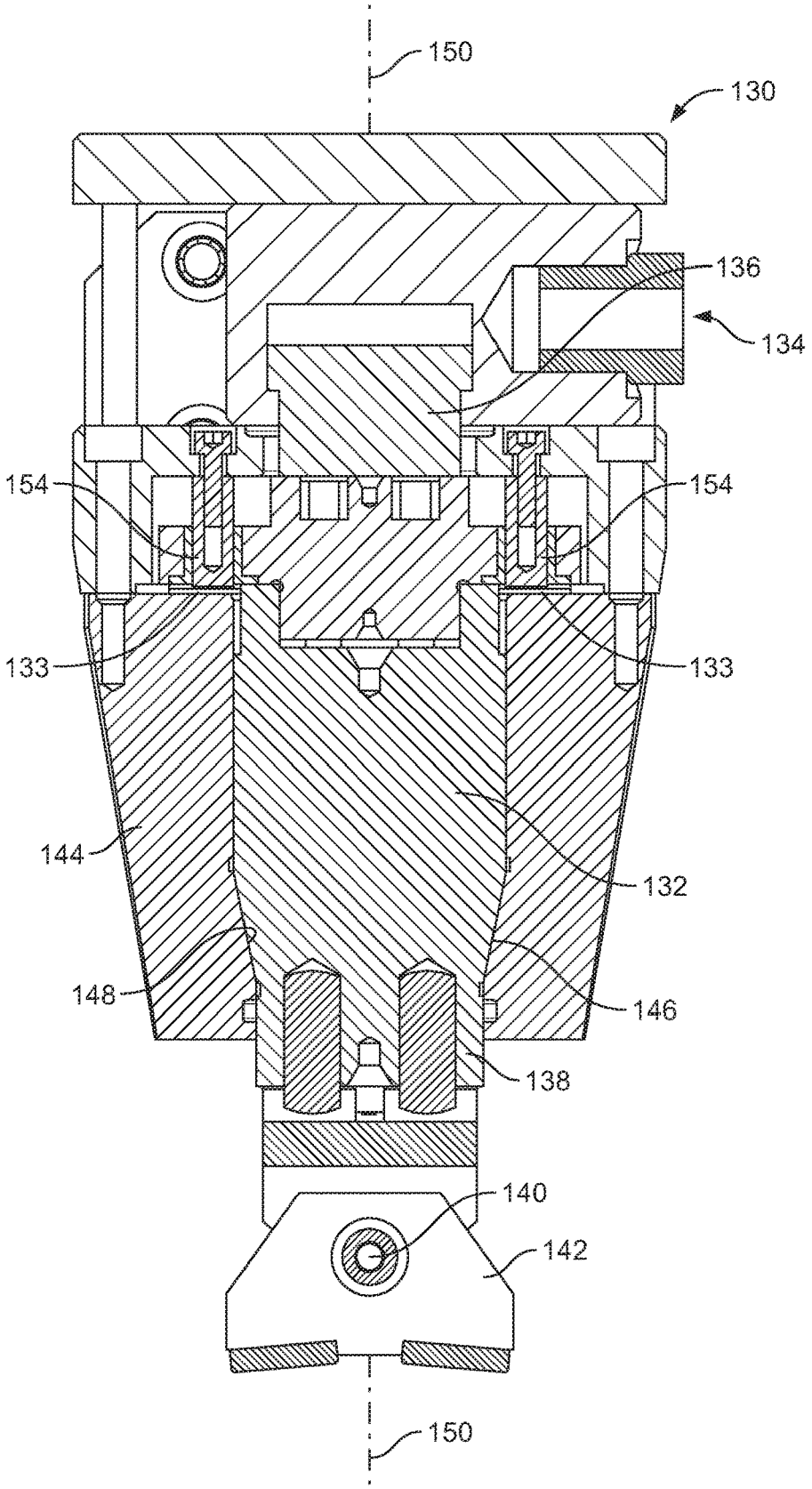
FIG. 16 shows a cross-sectional plan view of an alternative linear workrest actuation assembly.

FIG. 16 shows another workrest actuation assembly 130 for mechanically switching a workrest in a linear direction between advanced and retracted positions. A drive component 132 is coupled to a piston 136. The actuation assembly includes a hydraulic piston driving assembly 134 which is operable to drive the piston towards an advanced position. The piston acts against return springs 133. When the force exerted on the piston by the piston driving assembly is relaxed, the drive component is returned to its retracted position by the return springs.

The opposite end of the drive component 132 is pivotably coupled via a pivot 140 to a workrest 142. Actuation of the piston causes the drive component 132 to move relative to an actuator body 144. Anti-rotation pins 154 are mounted on the actuator body and are slidably engaged with the drive component. These pins serve to prevent rotation of the drive component (and therefore the workrest 142) relative to the actuator body.

The assembly 130 is shown in its advanced configuration in FIG. 16. In this configuration, a frustoconical surface 146 defined by the drive component 132 is engaged with a complementary surface 148 defined by the actuator body. This interface provides kinematic location of the drive component relative to the actuator body. The frusto-conical surface 146 has a central axis 150. This axis also extends through the centre of the piston 136 and the workrest 142. Alignment of the force exerted by the piston with the frusto-conical surface 146 and the workrest serves to increase the stiffness of the actuation assembly in its advanced configuration.

Figure 17:
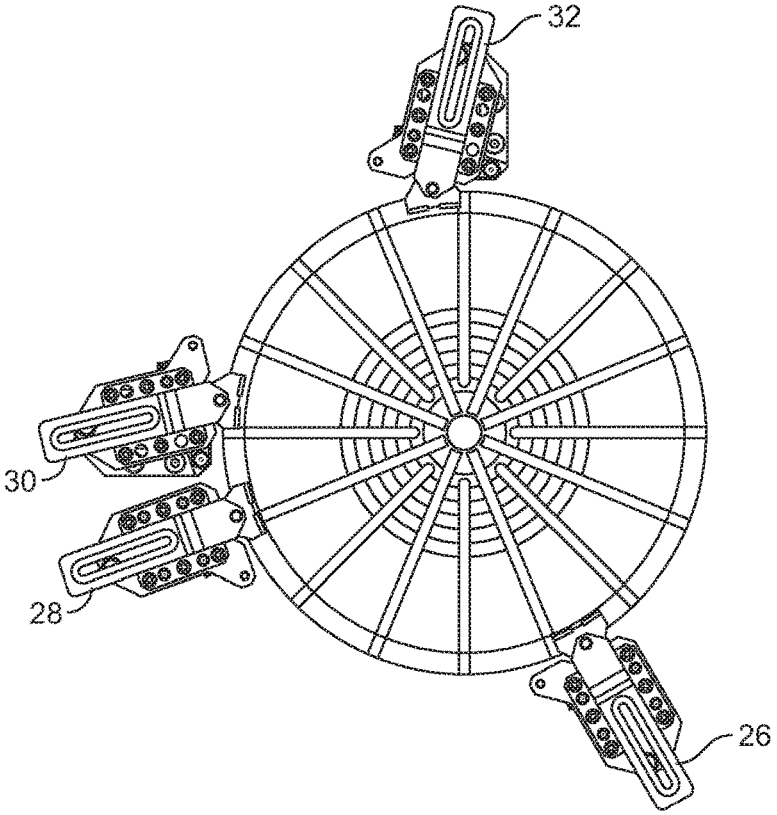
FIGS. 17 and 18 show two different workrest configurations in a workpiece holding assembly according to an embodiment of the invention.
Figure 18:
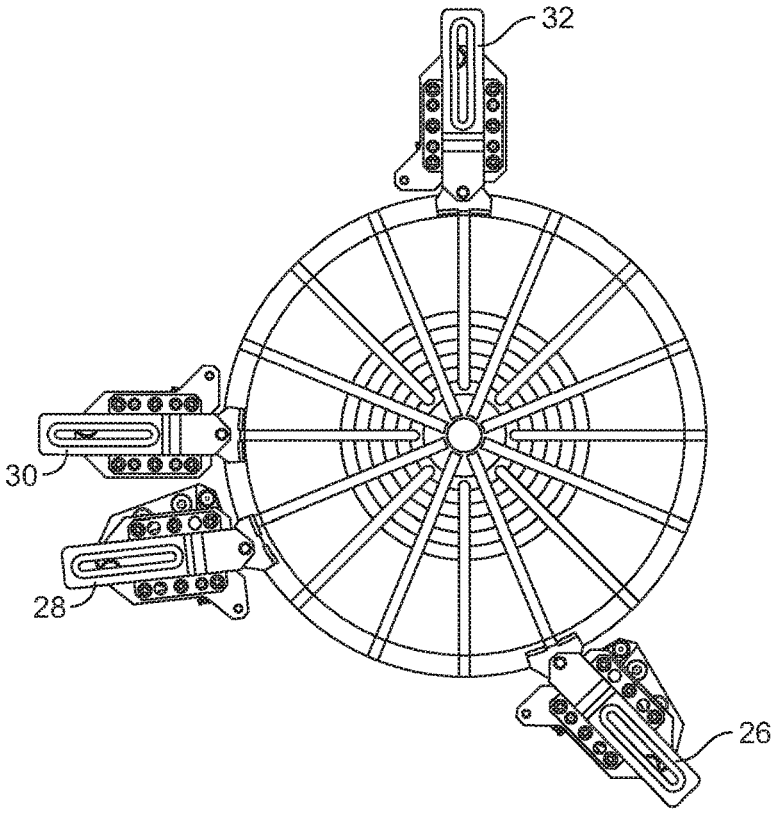
Figure 19:
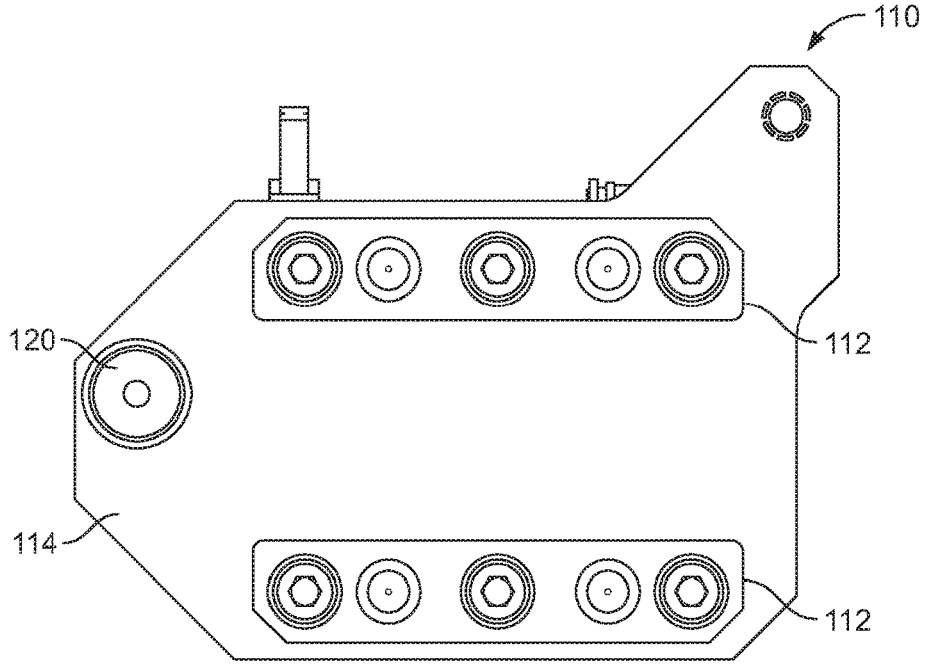
FIGS. 19 and 20 are plan views of a rotary workrest actuation assembly in two different orientations.

FIGS. 17 and 18 illustrate a workpiece holding assembly having a circumferential arrangement of workrests similar to that shown in FIG. 8. In this example, the workrests are movable between retracted and advanced positions using workrest actuation assemblies which operate in a rotary manner.

In the configuration shown in FIG. 17, workrests 26 and 28 are in their advanced positions for carrying out grinding of the outer circumferential surface of a workpiece. The workrests 30 and 32 have been pivoted into retracted positions where they are spaced from the outer circumferential surface of the workpiece. Conversely, in FIG. 18, workrests 30 and 32 are in their advanced positions for carrying out grinding of the inner circumferential surface of the workpiece. The workrests 26 and 28 have been pivoted into their retracted positions.

FIGS. 19 to 22 relate to a workrest actuation assembly 110 for mechanically switching a workrest in a rotary manner between advanced and retracted positions as illustrated by FIGS. 17 and 18. The assembly 110 includes a pair of shoe arm clamp blocks 112 for clamping a workrest finger support (not shown) therebetween. The shoe arm clamp blocks are mounted on an upper shoe support plate 114. The assembly also includes a lower support plate 116. In use, the assembly is fixed to a supporting surface using securing bolts 118.

Figure 20:
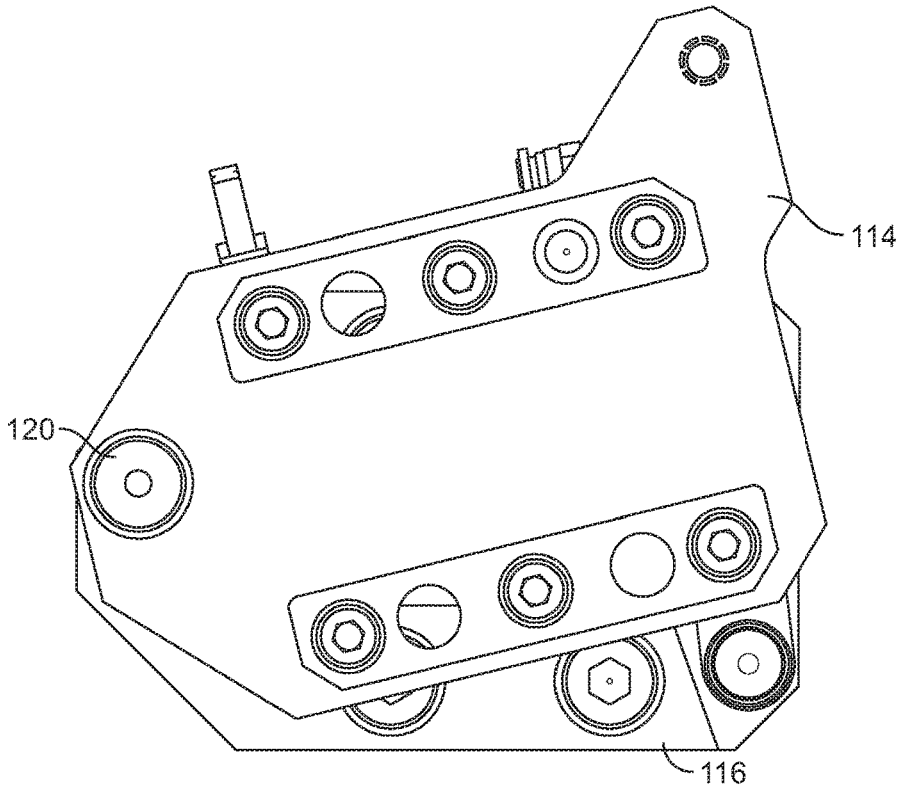
Figure 21:
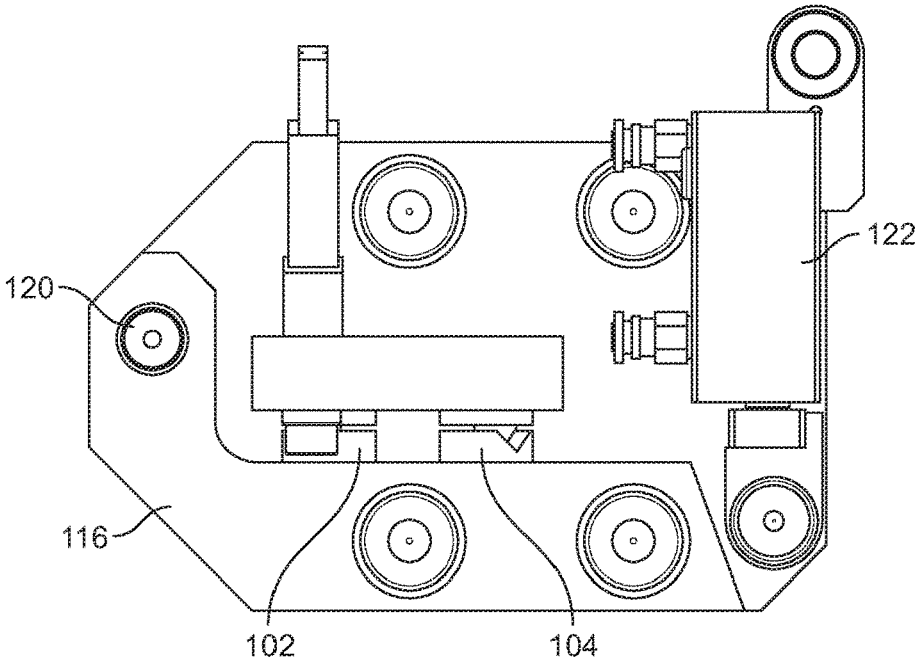
FIG. 21 is a plan view of the workrest support portion of the workrest actuation assembly shown in FIGS. 18 and 19.
Figure 22:
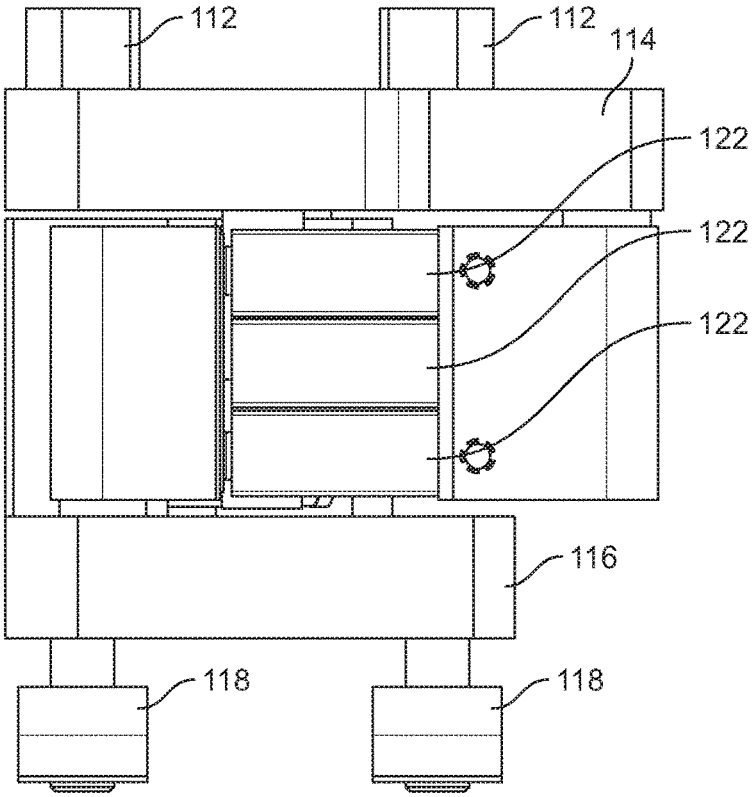
FIG. 22 is a side view of the workrest assembly shown in FIGS. 19 and 20.

The upper shoe support plate 114 is pivotably coupled to the lower support plate 116 by a pivot 120. In FIG. 20, the upper support plate has been pivoted relative to the lower support plate about the pivot 120. The assembly includes three swivel action pistons 122 for driving the upper support plate between its pivoted and non-pivoted positions. The pistons may be pneumatically or hydraulically operated.

In embodiments described herein, "approximately", "substantially" and "around" may mean plus or minus 5% or 5° of the stated value.

It will be appreciated that references herein to perpendicular or parallel relative orientations and the like are to be interpreted as defining perpendicular or parallel relationships between components within practical tolerances.

The invention claimed is:

1. A workpiece holding assembly for a grinding machine, the assembly comprising:

a magnetic chuck for holding a workpiece which has an outer circumferential surface and an inner circumferential surface located concentrically about a workpiece central axis;

a reversible chuck drive for rotating the chuck about a chuck rotational axis during grinding; and first and second separate sets of workrests for engaging with the outer circumferential surface of an annular workpiece held by the chuck with a transverse side surface in engagement with the chuck, wherein the workrests of at least one of the first and second sets of workrests are configured as movable workrests which are movable relative to the chuck rotational axis independently of the workrests of the other set, such that:

when the outer circumferential surface of said workpiece is ground by a grinding wheel rotating in a grinding wheel rotation direction with the chuck rotating in a chuck rotation direction, the outer circumferential surface is only urged in contact with the first set of the first and second sets of workrests; and when the inner circumferential surface of said workpiece is ground by a grinding wheel rotating in the grinding wheel rotation direction, with the direction of rotation of the chuck reversed relative to the chuck rotation direction during grinding of the outer circumferential surface, the outer circumferential surface is only urged in contact with the second set of the first and second sets of workrests.

2. The assembly of claim 1, wherein each of the workrests of at least one of the first and second sets of workrests is coupled to the assembly via a coupling which allows the workrests to be switched between predetermined advanced and retracted positions relative to the chuck rotational axis.

3. The assembly of claim 1, wherein each movable workrest is coupled to a respective workrest support, and a workrest actuator is provided in association with each movable workrest, with each workrest actuator operable to move the respective workrest relative to its workrest support.

4. The assembly of claim 3, wherein each of the workrests of at least one of the first and second sets of workrests is coupled to the assembly via a coupling which allows the workrests to be switched between predetermined advanced and retracted positions relative to the chuck rotational axis; and wherein each workrest actuator is operable to switch the respective workrest between its advanced and retracted positions.

5. The assembly of claim 3, wherein each workrest actuator is operable to move the respective workrest in a linear manner relative to its workrest support.

6. The assembly of claim 5, wherein each workrest actuator is operable to move the respective workrest along a linear reference axis, each workrest actuator includes a drive assembly having a driven member which is coupled to the workrest, and the linear reference axis extends through the driven member and the workrest.

7. The assembly of claim 5, wherein each workrest actuator includes a drive assembly having a driven member which is coupled to the workrest and is slideable relative to an actuator body between advanced and retracted positions, and the driven member and the actuator body define complementary frustoconical surfaces which engage each other when the driven member is in its advanced position.

8. The assembly of claim 7, wherein each workrest actuator is operable to move the respective workrest along a linear reference axis, each workrest actuator includes a drive assembly having a driven member which is coupled to the workrest, and the linear reference axis extends through the driven member and the workrest; and wherein a central reference axis of the frustoconical surfaces coincides with the linear reference axis.

9. The assembly of claim 3, wherein each workrest actuator is operable to move the respective workrest in a rotary manner relative to its workrest support.

10. The assembly of claim 1, wherein each of the first and second sets of workrests consists of two workrests.

11. A grinding machine including a machine base and the workpiece holding assembly of claim 1 carried by the machine base.

12. The machine of claim 11, including a grinding wheel having a grinding surface comprising CBN material.

13. A method of grinding a workpiece having an outer circumferential surface and an inner circumferential surface using the workpiece holding assembly of claim 1 to hold the workpiece, the method comprising the steps of:

rotating the workpiece in a first workpiece rotation direction during grinding of the outer circumferential surface with a grinding wheel rotating in a grinding wheel rotation direction; and rotating the workpiece in a second workpiece rotation direction opposite to the first workpiece rotation direction during grinding of the inner circumferential surface, with the grinding wheel rotating in the grinding wheel rotation direction.

14. The method of claim 13, wherein the grinding wheel rotates in a direction opposite to the first workpiece rotation direction during grinding of the outer circumferential surface; and the grinding wheel rotates in the same direction as the first workpiece rotation direction during grinding of the inner circumferential surface.

15. The method of claim 13, wherein the grinding wheel rotates in the same direction as the first workpiece rotation direction during grinding of the outer circumferential surface; and the grinding wheel rotates in a direction opposite to the first workpiece rotation direction during grinding of the inner circumferential surface.

16. The method of claim 13, wherein each workrest has a workpiece engagement surface which is spaced radially from a locus defined by the outer circumferential surface of the workpiece when the workpiece is located with the workpiece central axis coaxial with the chuck rotational axis.

17. The method of claim 13, wherein the workrests of the first and second sets of workrests are located in the same respective positions relative to the chuck during the step of grinding the outer circumferential surface of the workpiece as during the step of grinding the inner circumferential surface of the workpiece.

18. The method of claim 13, wherein the workrests of at least one of the first and second sets of workrests are located in different respective positions relative to the chuck during the step of grinding the outer circumferential surface of the workpiece from their respective positions relative to the chuck during the step of grinding the inner circumferential surface of the workpiece.

* * * * *